US005624222A

United States Patent [19]

Hiatt et al.

[11] Patent Number: 5,624,222

[45] Date of Patent: Apr. 29, 1997

[54] PANEL INSTALLER

[75] Inventors: Steven A. Hiatt, DeWitt; Lyle J. Heeg, Grand Ledge, both of Mich.

[73] Assignee: HNH, Inc., DeWitt, Mich.

[21] Appl. No.: 496,969

[22] Filed: Jun. 30, 1995

[51] Int. Cl.[6] ..... B66F 9/18

[52] U.S. Cl. ..... 414/11; 269/17; 269/904; 269/905; 414/590; 414/607

[58] Field of Search ..... 269/17, 904, 905; 414/11, 590, 607; 294/81.2, 81.3, 81.6, 67.22, 67.33, 67.41

[56] References Cited

U.S. PATENT DOCUMENTS

| | | | |
|---|---|---|---|
| 3,257,142 | 6/1966 | Barry . | |
| 3,409,158 | 11/1968 | Lull | 414/590 X |
| 3,552,583 | 1/1971 | Toffolon . | |
| 3,625,504 | 12/1971 | Walker . | |
| 3,643,935 | 2/1972 | Bell | 269/16 |
| 3,909,056 | 9/1975 | Duwe | 414/11 X |
| 3,923,167 | 12/1975 | Blankenbeckler . | |
| 3,926,318 | 12/1975 | Kister . | |
| 4,354,795 | 10/1982 | Dutra, Jr. | 414/622 |
| 4,375,934 | 3/1983 | Elliott | 414/11 |
| 4,467,893 | 8/1984 | Hobson | 414/607 X |
| 4,600,349 | 7/1986 | Vogt | 414/225 |
| 4,810,151 | 3/1989 | Shern | 414/11 |
| 5,127,791 | 7/1992 | Attman | 414/11 X |
| 5,224,808 | 7/1993 | Macris | 414/11 |

FOREIGN PATENT DOCUMENTS

| | | | |
|---|---|---|---|
| 1-192955 | 8/1989 | Japan | 414/11 |

*Primary Examiner*—David A. Bucci
*Assistant Examiner*—Janice L. Krizek
*Attorney, Agent, or Firm*—Ian C. McLeod; Mary M. Moyne

[57] ABSTRACT

An apparatus (10) and rail system (80) for installing divider wall panels (100) into ceiling rails, is described. The apparatus includes a base (12) which is adapted to be attached to a forklift truck (200). A frame (22) is rotatably mounted on the base and includes vertical members (24) to which are mounted support channels (50) and a holding channel (54). The channels act together along the sides (100C) of the panel to hold the panel in the apparatus. An end channel (60) is connected to one of the support channels and to the holding channel and is mounted to one end (100B) of the panel. The rail system includes an entry rail (82) comprised of rail segments (84 and 86) with a keyway (88) therebetween and a rail key (95). In use, the panel is mounted in the apparatus which is attached to the forklift truck. The channels are tightened around the panel to hold the panel in the apparatus. The forklift truck then lifts the apparatus and the panel. As the panel is lifted, the panel and the frame rotate on the base to move the panel into the vertical position. The rail key is placed on the end of the panel away from the ground surface (202) and the panel is positioned in the keyway of the entry rail. The panel and apparatus are then lowered until the rail key is completely in the keyway and aligned with the rail segments of the entry rail. The apparatus is then removed from the panel and the panel is slid into the ceiling rails.

18 Claims, 8 Drawing Sheets

PANEL INSTALLER

BACKGROUND (1) Field of the Invention

The present invention relates to an apparatus and a rail system and method for installing divider wall panels. In particular, the present invention relates to an apparatus for use with a forklift truck which allows for lifting and rotating a divider wall panel in order to install the panel into ceiling rails using a rail system.

(2) Description of Related Arts

The related art shows several apparatus for positioning panels for installation. Illustrative are U.S. Pat. Nos. 4,810,151 to Shern; 3,923,167 to Blankenbeckler; 3,643,935 to Bell and 3,926,318 to Kister.

Shern describes a door transporting and mounting machine having a wheeled support frame upon which is mounted a vertical column. A roller carriage is mounted on the vertical column and is movable between upper and lower positions. Door gripping arms are pivotally mounted to the roller carriage and grip the door along the sides to allow for rotating the door from the horizontal transporting position to the vertical mounting position. The movability of the roller carriage allows the gripping arms and thus the door to be lifted vertically in order to mount the door.

Blankenbeckler shows an apparatus for handling a door which includes a main frame pivotally mounted to a base assembly, a carriage support frame slidably mounted in the main frame and a carriage slidably mounted on the carriage support frame. A brake assembly is rotatably mounted on the carriage and a pair of parallel, spaced apart telescoping arms are mounted on the brake assembly. The telescoping arms have grasping means on the ends in order to grasp the door. The grasping means are rotatably mounted to the ends of the arms in order to allow the grasping means to be rotated to grasp the door when the door is in the vertical position.

Bell describes a workbench which allows a panel to be shifted into various positions to enable the user to work on different areas of the panel. The workbench can also be used to move the panel and to position the panel to allow for easy installation.

Kister describes a panel handling device having horizontally extending, separable connecting means which cooperates with a connecting means on the panel. The handling device is able to lift large, rectangular panels and rotate the panels 90° for positioning the panels with their long edges extending vertically. The connecting means of the device is a projection which fits within a hole in the panel.

Also of interest are U.S. Pat. Nos. 5,224,808 to Macris; 4,600,349 to Vogt; 4,467,893 to Hobson; 4,375,934 to Elliott; 3,625,504 to Walker and 3,552,583 to Toffolon which show various apparatus for lifting, positioning or installing doors or panels. Only remotely of interest are U.S. Pat. Nos. 3,257,142 to Barry and; 4,354,795 to Dutra, Jr.

There remains a need for an apparatus and rail system which is used with a forklift truck and which lifts and rotates a divider wall panel for easy installation of the panel into ceiling rails.

OBJECTS

It is therefore an object of the present invention to provide a panel positioning and installing apparatus for use with a forklift truck which allows for easy lifting and positioning of divider wall panels for installation into ceiling rails. Further, it is an object of the present invention to provide a rail system which allows for quick and easy installation of divider wall panels into ceiling rails. Still further, it is an object of the present invention to provide a panel positioning and installing apparatus and a rail system which allow two persons to quickly and easily install large divider wall panels into ceiling rails. Further, it is an object of the present invention to provide a panel positioning and installing apparatus which is inexpensive to construct and easy to use and maintain. These and other objects will become increasingly apparent to those skilled in the art and by reference to the description and the drawings.

DETAILED DESCRIPTION OF THE PREFERRED EMBODIMENTS

Figure 1:
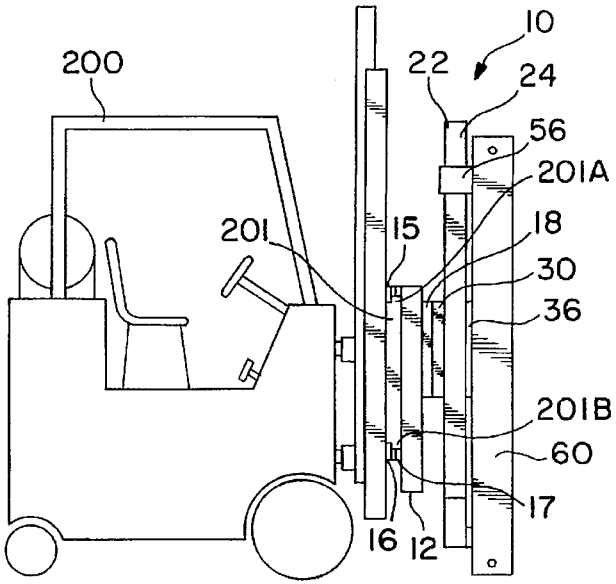
FIG. 1 is a left side view of the apparatus 10 attached to the forklift truck 200 with the frame 22 in the horizontal position.

The present invention relates to an apparatus for use with a lifting means for installing divider wall panels into ceiling rails where the panels have opposed ends with spaced apart sides therebetween, the apparatus which comprises: a base with attachment means for attaching to the lifting means; a frame rotatably mounted on the base and having a top and a bottom with opposed sides extending therebetween when the frame is oriented for mounting a panel on the apparatus; a support channel mounted on the bottom of the frame wherein when the panel is positioned in the apparatus, the support channel is adjacent one side of the panel; an adjustable holding means mounted on the panel so as to hold the panel in the support channel; and a support means connected to, spaced apart from and extending between the support channel and the holding means wherein the support means is extendable to engage one of the ends of the panel when the panel is positioned in the apparatus and wherein to position the panel for installation into the ceiling rails, the frame with the panel is rotated approximately about 90° on the base so that the support means is adjacent a ground surface.

Further, the present invention relates to an apparatus for use with a lifting means for installing divider wall panels into ceiling rails where the panels have opposed ends with spaced apart sides therebetween, the apparatus which comprises: a base with attachment means for attaching to the lifting means; a frame rotatably mounted on the base and having a top and a bottom with opposed sides extending therebetween when the frame is oriented for mounting a panel on the apparatus; a support channel mounted on the bottom of the frame; an adjustable holding means mounted on the top of the frame spaced apart and parallel to the support channel and extending between the ends of the frame wherein when the panel is positioned in the apparatus, the support channel is adjacent one side of the panel and the holding means is adjacent the other side of the panel; and a support means connected to, spaced apart from and extending between the support channel and the holding means wherein the support means is extendable to engage one of the ends of the panel when the panel is positioned in the apparatus and wherein to position the panel for installation into the ceiling rails, the frame with the panel is rotated approximately about 90° on the base so that the support means is adjacent a ground surface.

Further, the present invention relates to a method for installing divider wall panels into ceiling rails, the panels having opposed ends with sides extending therebetween, with rollers adjacent one of the ends, the method which comprises: providing a lifting means for positioning the end of the panel having the rollers adjacent the ceiling rails; providing a keyway in the ceiling rails having a length greater than the distance between the sides of the panel; providing a rail key having opposed ends with a top wall and a bottom wall extending therebetween for positioning within the keyway of the ceiling rail; mounting the rail key on the end of the panel having the rollers; positioning the panel adjacent the ceiling rail so that the rail key is above the ceiling rail; lowering the panel in the keyway so that the rail key is in the keyway; and moving the panel out of the rail key into the ceiling rail.

Further, the present invention relates to an apparatus for use with a lifting means for installing divider wall panels into ceiling rails for a commercial building where the panels have opposed ends with spaced apart sides therebetween and are at least between about 12 and 40 feet (366 and 1219 cm) long and between about 2 and 6 feet (61 and 183 cm) wide, the apparatus which comprises: a base with attachment means for attaching to the lifting means; a frame rotatably mounted on the base and having a top and a bottom with opposed sides extending therebetween when the frame is oriented for mounting a panel on the apparatus; a support channel mounted on the bottom of the frame; an adjustable holding means mounted on the top of the frame spaced apart and parallel to the support channel and extending between the ends of the frame wherein when the panel is positioned in the apparatus, the support channel is adjacent one side of the panel and the holding means is adjacent the other side of the panel; and a support means connected to and spaced apart from the support channel and the holding means wherein the support means is extendable to engage one of the ends of the panel when the panel is positioned in the apparatus and wherein to position the panel for installation into the ceiling rails, the frame with the panel is rotated approximately about 90° on the base so that the support means is adjacent a ground surface.

Still further, the present invention relates to a method for installing divider wall panels into ceiling rails, the panels having opposed ends with sides extending therebetween, with rollers adjacent one of the ends, the method which comprises: providing a keyway in the ceiling rails having a length greater than the distance between the sides of the panel; providing a rail key having opposed ends with a top wall and a bottom wall extending therebetween for positioning within the keyway of the ceiling rail; mounting the rail key on the end of the panel having the rollers; positioning the panel adjacent the ceiling rail so that the rail key is above the ceiling rail and the panel is in the keyway; lowering the panel in the keyway so that the rail key is in the keyway; and moving the panel out of the rail key into the ceiling rail.

Further, the present invention relates to a rail system for use in installing divider wall panels along a ceiling of a building, the panels having opposed ends with sides extending therebetween having rollers adjacent one of the ends, the system which comprises: a first ceiling rail having opposed ends with a top wall and a bottom wall extending therebetween forming a first central opening in the ceiling rail to be mounted with the top wall adjacent the ceiling and having a first slot in the bottom wall; a second ceiling rail having opposed ends with a top wall and a bottom wall extending therebetween forming a second central opening and a keyway between the opposed ends extending through the top wall and the bottom wall, the second ceiling rail having a second slot in the bottom wall and to be mounted with the top wall adjacent the ceiling so that the second central opening of the second ceiling rail is aligned with the first central opening of the first ceiling rail; a rail key having opposed ends with a top wall and a bottom wall extending therebetween forming a central opening and having a slot in the bottom wall, the rail key to be inserted and held in the keyway of the second ceiling rail wherein the rail key is positioned on one of the ends of the panels and the panel is lifted and positioned so that the rail key is in the keyway of the second ceiling rail and wherein the panel is moved from the second ceiling rail to the first ceiling rail; and a connector rail having a shape and size similar to the second ceiling rail without the keyway, to be mounted in place of the second ceiling rail after the panels have been installed.

Figure 13:
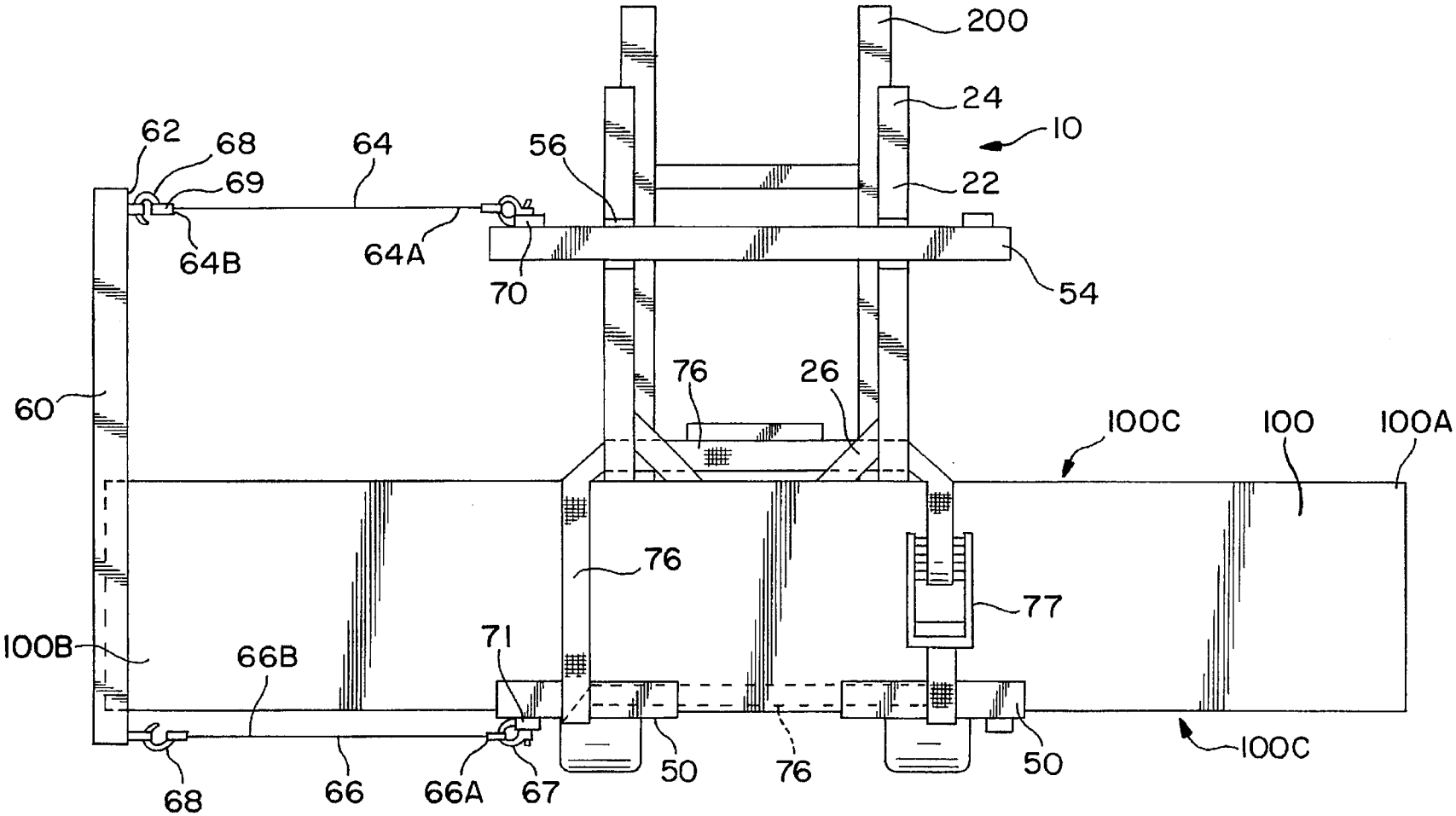
FIG. 13 is a front view of the apparatus 10 of FIG. 1 showing an alternate mounting of a panel 100 in the apparatus 10 as a single securing strap 76.

FIGS. 1 to 12 show the panel positioning and installing apparatus 10 and the rail system 80 of the present invention. The panel positioning and installing apparatus 10 and rail system 80 are used to install divider wall panels 100 into ceiling rails (not shown) to form standard collapsible divider walls (not shown) in preferably commercial buildings. The panels 100 could also be in the form of a door which is installed on hinges (not shown) (FIG. 13). The panels 100 are preferably rectangular in shape having opposed ends 100A and 100B with sides 100C extending therebetween. In the preferred embodiment, the panels 100 have a length of between about 12 and 40 feet (366 and 1219 cm) by the ends 100A and 100B, a width of between about 2 and 6 feet (61 and 183 cm) between the sides 100C and a thickness of between about 2 and 5 inches (5.08 and 12.7 cm). The panels 100 are preferably constructed of drywall, wood, steel, or aluminum or a combination thereof and weigh up to about 2,000 lbs (0.91 metric ton). The panels 100 are also provided with sliding wheels 102 at one end 100A which allow the panels 100 to be moved along the ceiling rails in order to allow the divider wall, formed by the panels 100, to be collapsible. The panels 100 are preferably similar to conventional divider wall panels such as that manufactured by Hufcor, Jamesville, Wis.

The ceiling rails into which the panels 100 are installed are preferably rectangular in shape and have a top wall, a bottom wall, with sidewalls extending therebetween forming a central opening. The ceiling rails are mounted such that the top wall is parallel and adjacent to the ceiling of the building. The bottom wall of the rails has a slot which allows for mounting of the panels 100 in the opening and movement of the panels 100 along the rails. In the preferred embodiment, each of the rails has a length of about 10 feet (305 cm) and are mounted end to end such as to form a continuous rail (not shown) of a length necessary to divide the necessary area of the building. Preferably, the ceiling rails are similar to those conventionally used to mount divider wall panels 100.

Figure 7:
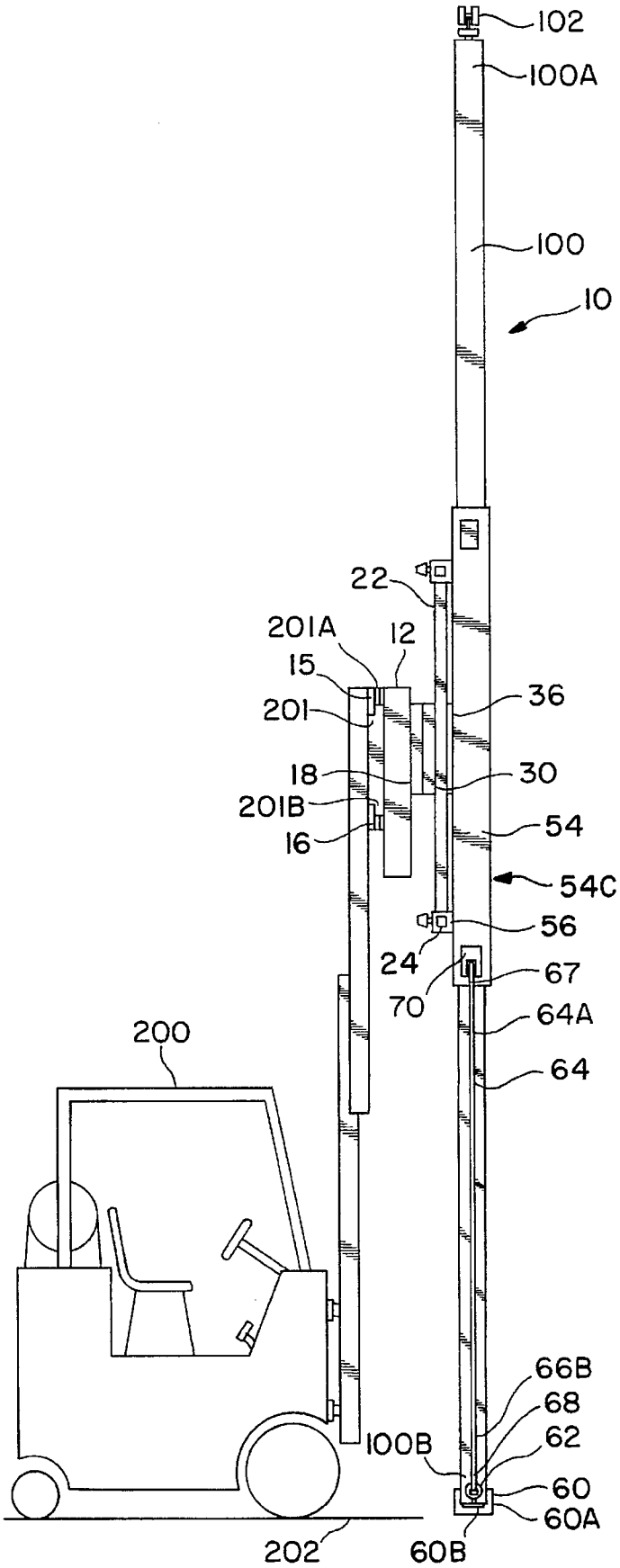
FIG. 7 is a left side view of the apparatus 10 attached to the forklift truck 200 with the panel 100 in the lifted and vertical position.
Figure 8:
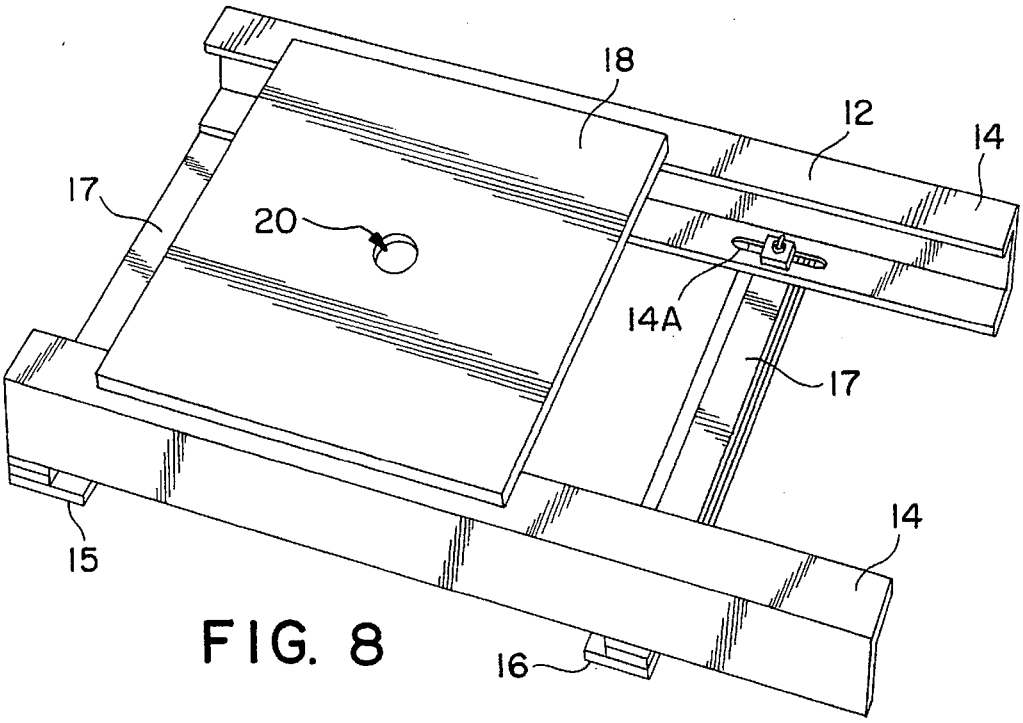
FIG. 8 is a partial perspective view of the base 12 showing the base members 14, base plate 18 and support bars 15 and 16.
Figure 9:
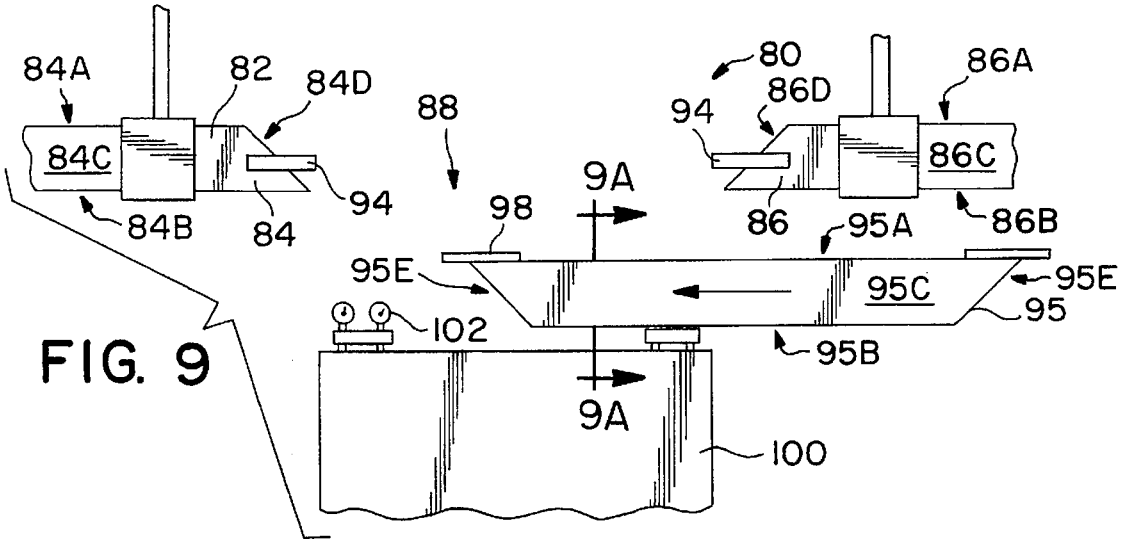
FIGS. 9 to 12 show the steps for the installation of the divider wall panels 100 into the ceiling rails using the rail system 80.
Figure 9A:
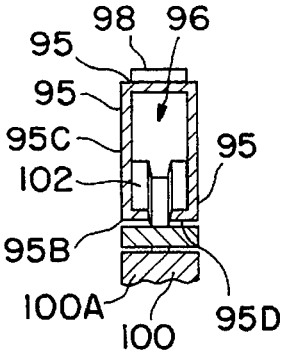
FIG. 9A is a cross-sectional view of Figure 9 along the line 9A—9A showing the rail key 95 showing the slot 95D in the bottom wall 95B and the wheels 102 mounted in the center opening 96 of the rail key 95.
Figure 10:
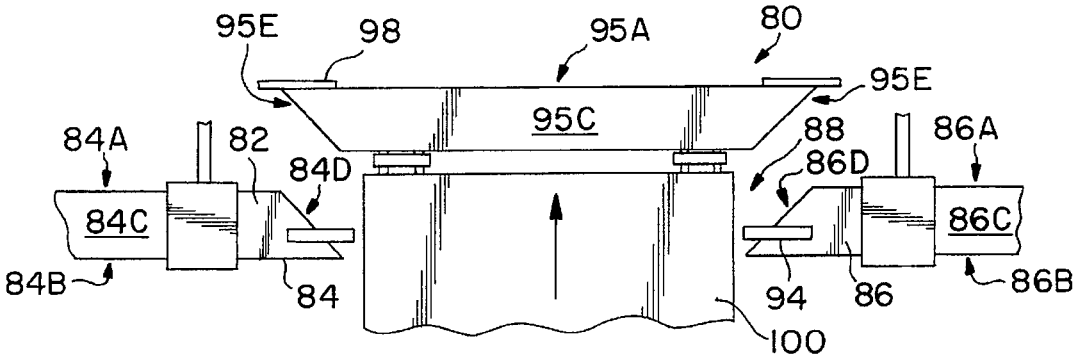
Figure 11:
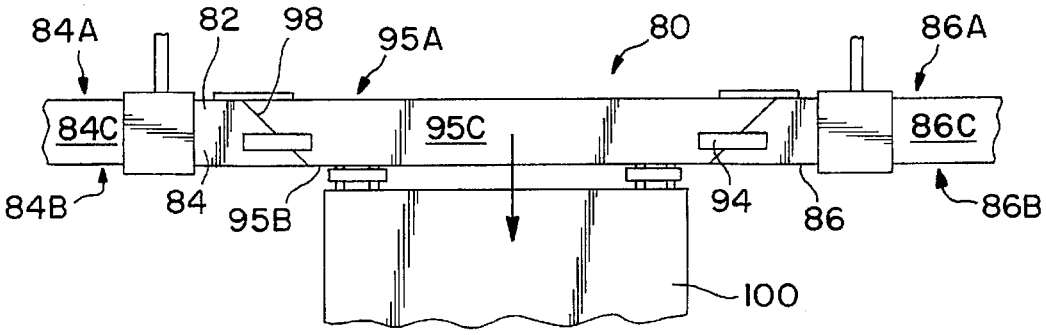
Figure 12:
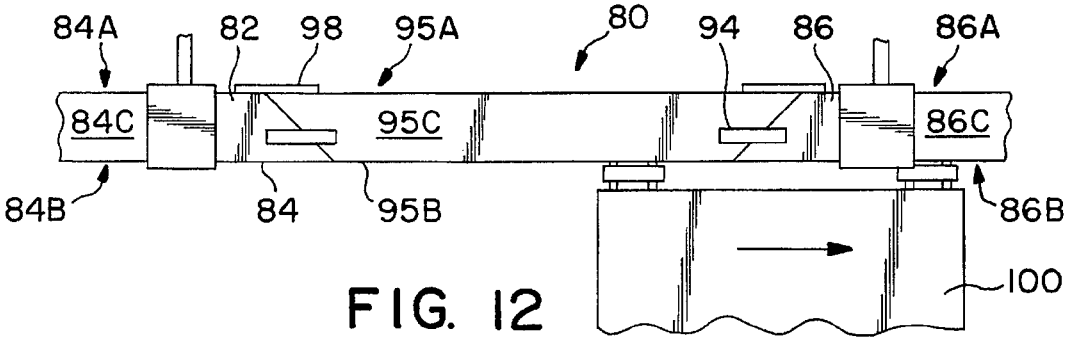

The panel positioning and installing apparatus 10 includes a base 12, a frame 22 rotatably mounted on the base 12 and support, holding and end channels 50, 54 and 60 for holding the panel 100 in the apparatus 10. The base 12 has two spaced apart, parallel base members 14 which are connected together by support bars 16 (FIG. 8). In the preferred embodiment, the base 12 is constructed for attachment to a forklift truck 200. Other lifting devices (not shown) such as a jack or crane can also be used to raise and lower the apparatus 10. When other types of lifting devices are used, the construction of the base 12 may be adjusted accordingly. Preferably, there are two support bars 15 and 16 which are mounted on one side of the members 14, spaced apart along the length of the members 14. Spacers 17 are provided between the members 14 and the support bars 15 and 16 act to position the support bars 15 and 16 away from the members 14. Preferably, the spacers 17 move the support bars 15 and 16 away from the members 14 a distance slightly greater than the thickness of the attachment plate 201 of the forklift truck 200. The attachment plate 201 preferably has upper and lower extensions 201A and 201B. In the preferred embodiment, the forklift truck 200 is similar to a conventional forklift truck. The base members 14 and the support bars 15 and 16 allow for attachment of the apparatus 10 on the attachment plate 201 of the forklift truck 200 (FIGS. 1 and 7). The upper support bar 15 is preferably permanently mounted to the upper end of the members 14 (FIG. 8). The lower support bar 16 is preferably adjustable along slots 14A (one shown) in the members 14 so as to allow the base 12 to be mounted onto forklift trucks having different sized attachment plates. A base plate 18 is secured between the members 14 on the side opposite the support bars 16 and helps to connect the members 14 together. The base plate 18 has a hole 20 in the center which allows for rotatably mounting the frame 22.

Figure 3:
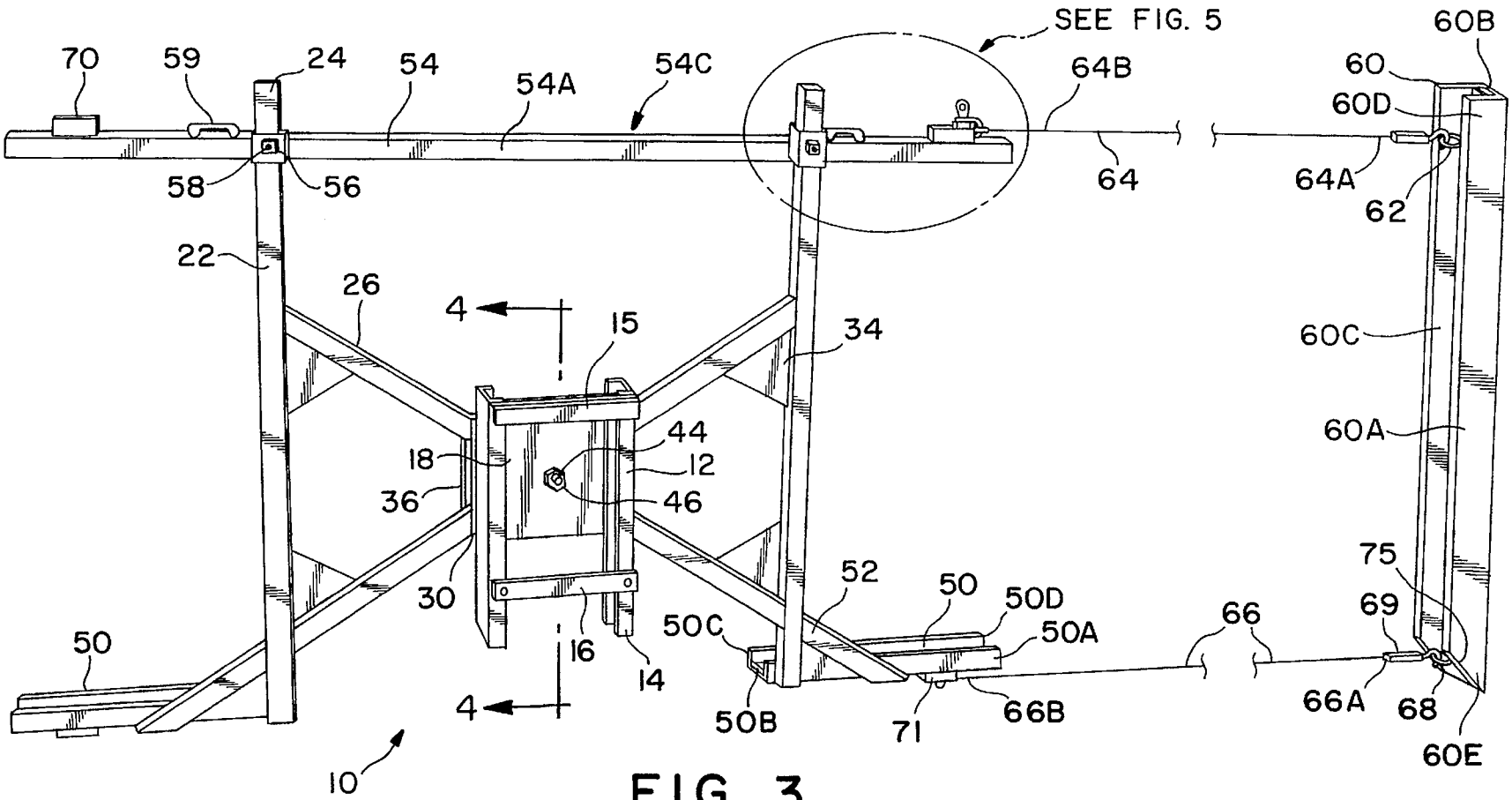
FIG. 3 is a perspective rear view of the apparatus 10 showing the frame 22, the support channels 50, the holding channel 54 and the securing end channel 60.
Figure 5:
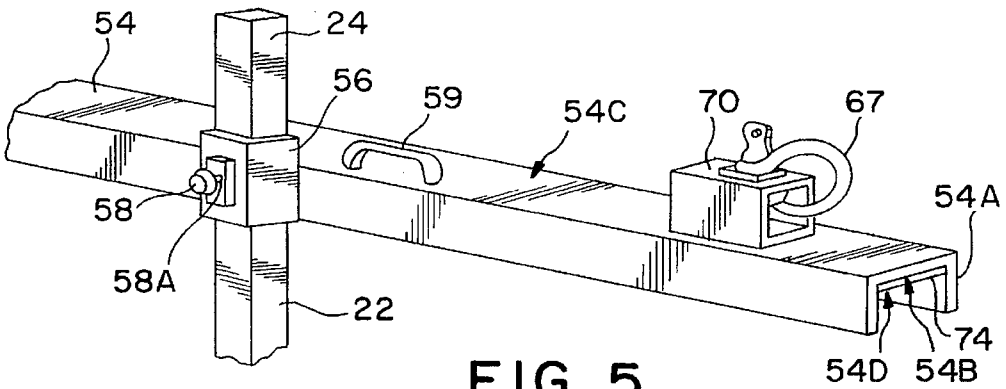
FIG. 5 is a partial enlarged view of FIG. 3 showing the positioning knob 58 on the sleeve 56 and the shackles 67.
Figure 6:
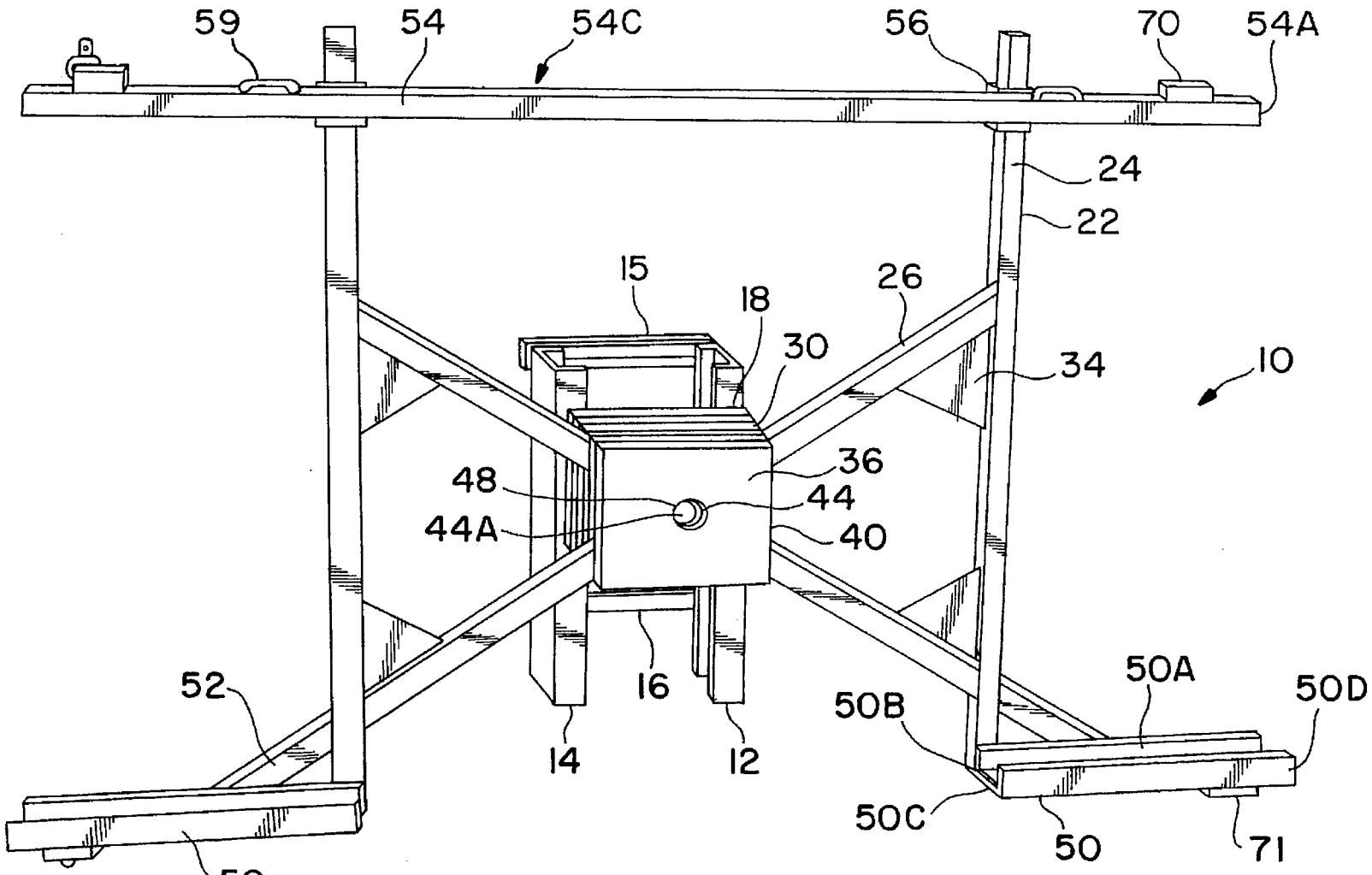
FIG. 6 is a front view of the apparatus 10 showing the support channels 50 and the holding channel 54 mounted on the frame 22.

The frame 22 has a generally rectangular shape with two vertical members 24 and four cross members 26 which are mounted between the vertical members 24 (FIGS. 3 and 6). Preferably, there are four cross members 26 which extend inward, two from each of the vertical members 24, to a central connection point 28. The cross members 26 are mounted at an angle so as to form an X between the vertical members 24. The four cross members 26 are preferably all the same length so as to form a symmetrical X and so that the central connection point 28 of the cross members 26 is spaced equally between the vertical members 24. The cross members 26 connect the vertical members 24 together and add support and strength to the apparatus 10. To provide additional support and strength, angled braces 34 are mounted in the corners formed between the vertical members 24 and the cross members 26. Preferably, there are four braces 34, one in each of the inner corners of the X formed by the cross members 26. A mounting plate 30 is preferably mounted on one side of the frame 22 over the central connection point 28 of the cross members 26. The mounting plate 30 has a hole 32 in the center and is preferably positioned over the central connection point 28 of the cross members 26 so that the hole 32 is positioned exactly in the center of the connection point 28 and is equally spaced from either vertical member 24.

Figure 4:
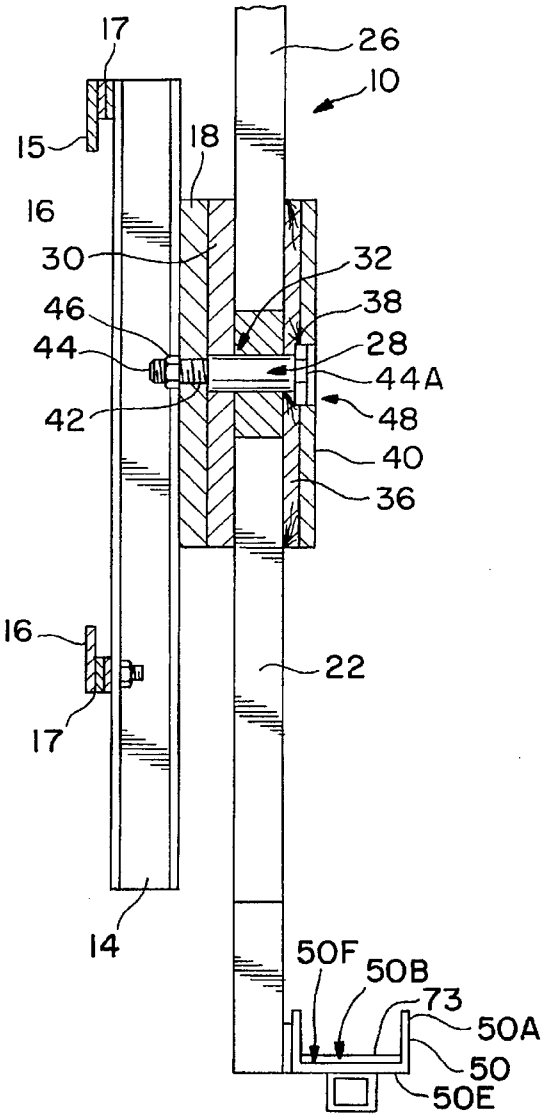
FIG. 4 is a cross-sectional view of the apparatus 10 of FIG. 3 along the line 4—4 showing the frame 22 rotatably mounted on the base 12 in a horizontal position.

As shown in FIG. 6, a face plate 36 is mounted on the cross members 26 on the side opposite the mounting plate 30. Preferably, the face plate 36 is similar in shape and size to the mounting plate 30 and has a hole 38 in the center and is positioned on the cross members 26 similarly to the mounting plate 30. The face plate 36 is preferably covered with a non-abrasive cover 40, or alternately has a non-abrasive surface, on the side opposite the cross members 26 (FIG. 4). The face plate 36 is used as a spacer to prevent the inner side of the panel 100 from being damaged by the head 44A of the rotation bolt 44 (to be discussed in detail hereinafter), when the panel 100 is mounted in the apparatus 10. A sleeve 42 or bushing is preferably inserted through the holes 32 and 38 of the mounting plate 30 and face plate 36 and preferably is flush with the side of the mounting plate 30 opposite the face plate 36. A hardened, rotation bolt 44 extends through the hole 20 in the base plate 18 of the base 12 and into the sleeve 42 extending through the mounting plate 30 and the face plate 36 in order to mount the frame 22 on the base 12. In the preferred embodiment, the mounting plate 30 and the base plate 18 are adjacent each other such that the base plate 18 acts to steady the mounting plate 30 and thus the frame 22 during rotation of the frame 22 on the base 12. A lubricant (not shown) is preferably provided between the mounting plate 30 and the base plate 18 to provide easier rotation of the frame 22 on the base 12 by reducing the friction between the plates 18 and 30 during rotation. Preferably, the rotation bolt 44 is secured in the sleeve 42 by a nut 46 adjacent the side of the base plate 18 opposite the mounting plate 30. Preferably, the head 44A of the bolt 44 is positioned in an indentation 48 in the side of the face plate 36 opposite the mounting plate 30. Alternately, the cover 40 on the face plate 36 extends outward beyond the head 44A of the bolt 44 so as to prevent the head 44A of the bolt 44 from making contact with and damaging the inner surface of the panel 100. Preferably, the vertical and cross members 24 and 26 of the frame 22 are constructed of tubular aluminum. Other materials however can also be used. The base 12 is preferably made of steel or any other similar material.

A pair of U-shaped support channels 50 having two legs 50A with a floor 50B therebetween are mounted at one end 50C to the vertical members 24 of the frame 22 on the side opposite the base 12 (FIGS. 3 and 6). The channels 50 are mounted on the frame 22 such that when the apparatus 10 is attached to the forklift truck 200 in the initial, unrotated position, the floor 50B of the support channels 50 are adjacent to and parallel with the ground surface 202 and the legs 50A of the channels 50 extend upward from the floor 50B, away from the ground surface 202. In the preferred embodiment, each of the support channels 50 is mounted such that one end 50C is adjacent one of the vertical members 24 of the frame 22 with the other end 50D extending outward perpendicular to the vertical member 24 away from the other vertical member 24. Thus, the support channels 50 do not extend into the area between the vertical members 24 of the frame 22. The support channels 50 are further supported and secured to the vertical members 24 by tubular braces 52 which extend downward from the vertical members 24 to one of the legs 50A of the channel 50 adjacent the vertical member 24 (FIG. 3). In the preferred embodiment, the tubular braces 52 are aligned with each pair of aligned cross members 26. In an alternate embodiment (not shown), a single support channel extends the entire distance between the vertical members 24 of the frame 22 and extends outward beyond each of the vertical members 24 of the frame 22. In the preferred embodiment, the distance between the ends 50C of the support channels 50 and the distance between the vertical members 24 of the frame 22 are the same and are such as to enable the apparatus 10 to be used with a forklift truck 200 to remove the divider wall panels 100 from the panel rack (not shown) on which the panels 100 are conventionally stored and transported.

A holding channel 54 is mounted on the vertical members 24 above and parallel to the support channels 50 such that the legs 54A of the channel 54 extend downward from the floor 54B of the channel 54 toward the support channels 50. The holding channel 54 is mounted to the vertical members 24 by sleeves 56 which slidably mount over the vertical members 24 and which allow the holding channel 54 to be adjusted toward or away from the support channels 50. The sleeves 56 are provided with positioning knobs 58 having threaded shafts 58A which extend through the sleeves 56 and into threaded holes (not shown) in the vertical members 24. Alternately, the shafts 58A of the positioning knobs 58 extend into direct contact with the vertical members 24 and hold the holding channel 54 in position by friction. The positioning knobs 58 act to hold the holding channel 54 above the support channels 50 on the vertical members 24 of the frame 22 a distance greater than the width of the panel 100 in order to allow the panel 100 to be placed between the channels 50 and 54 of the apparatus 10. The adjustability of the distance between the support channels 50 and the holding channel 54 enables the apparatus 10 to be used with panels 100 of different widths. In the preferred embodiment, the distance between the floors 50B and 54B of the channels 50 and 54 is able to be adjusted between about 2 and 6 feet (61 and 183 cm). The outer surface 54C of the floor 54B of the holding channel 54 opposite the legs 54A is provided with handles 59 which allow for easy lifting or lowering of the holding channel 54 during adjustment (FIG. 6).

Figure 2:
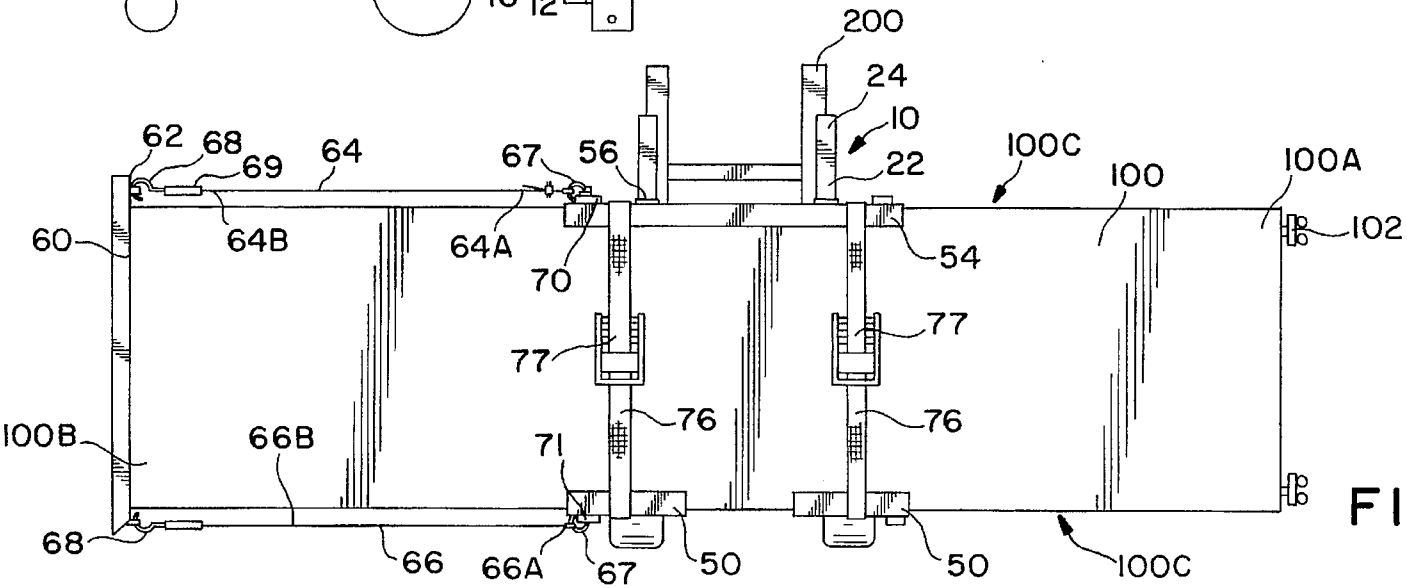
FIG. 2 is a front view of the apparatus 10 of FIG. 1 showing the frame 22 and panel 100.

A securing end channel 60 is preferably removably connected at one end 60D to the holding channel 54 and the adjacent end 50D of one of the support channels 50 (FIGS. 2 and 3). The end channel 60 is connected such as to be spaced apart from the frame 22 and the support and holding channels 50 and 54 and to extend between the support and holding channel 50 and 54 parallel to the vertical members 24 of the frame 22. The end channel 60 is preferably mounted such that the legs 60A of the channel 60 extend inward, toward the frame 22. The inner surface 60C of the floor 60B of the end channel 60 is preferably provided with a pair of eye bolts 62 adjacent the ends 60D and 60E of the end channel 60. The end channel 60 is preferably connected to the support and holding channels 50 and 54 by first and second cables 64 and 66 which have a shackle 67 at one end 64A and 66A and a hook 68 at the other end 64B and 66B. The ends 64A and 66A of the cables 64 and 66 adjacent the shackles 67 are adjustable in order to enable the distance between the end channel 60 and the support and holding channels 50 and 54 to be adjusted in order to allow panels 100 having different lengths to be securely mounted in the apparatus 10. The other ends 64B and 66B of the cables 64 and 66 are provided with turn buckles 69 adjacent the hooks 68. The turn buckles 69 allow for tensioning of the cables 64 and 66 to secure the end channel 60 onto the end 100B of the panel 100 once the panel 100 is mounted in the apparatus 10 in the initial, unrotated position. The shackle 67 on the end 64A of the first cable 64 is secured to an attachment mount 70 mounted to the outer surface 54C of the floor 54B of the holding channel 54. The hook 68 at the other end 64B of the first cable 64 is connected to the eye bolt 62 at one end 60D of the end channel 60. The second cable 66 is similarly connected between an attachment mount 71 on the outer surface 50E of the floor 50B of the adjacent support channel 50 and the other end 60E of the end channel 60. Preferably, the holding channel 54 is provided with an attachment mount 70 at each end and likewise preferably, each support channel 50 is provided with an attachment mount 71 such that the end channel 60 is able to be mounted onto either end of the holding channel 54 and either support channel 50 depending upon the position of the end 100A of the panel 100 having the sliding wheels 102. In the preferred embodiment, the support, holding and end channels 50, 54 and 60 have a width of about 5 inches (13 cm) between the legs 50A, 54A and 60A. The distance between the legs 50A, 54A or 60A of the channels 50, 54 or 60 is dependent on the thickness of the panel 100 to be mounted in the apparatus 10. Preferably, the inner surface 50F, 54D and 60C of the floors 50B, 54B and 60B of the channels 50, 54 and 60 are provided with a non-abrasive, protective covering 73, 74 and 75 which prevent the edges on the sides 100C of the panel 100 from being damaged by the channels 50, 54 and 60 when mounted in the apparatus 10. In the preferred embodiment, the channels 50, 54 and 60 are constructed of aluminum although other similar, suitable material could also be used. Further, the channels 50, 54 and 60 could be other shapes such as flat bars, provided they hold the panel 100 securely without damaging the panel 100.

In the preferred embodiment, two securing straps 76 are provided for securing the panel 100 between the channels 50 and 54 (FIG. 2). Alternately, if the panel 100 is small, only one strap 76 may be used (FIG. 13). The securing straps 76 are preferably between about 2 and 4 inches wide and are constructed of a material similar to nylon. Any material may be used to construct the straps 76; however, the material should be non-abrasive such as not to damage the panel 100 and should also be strong and non-resilient. The straps 76 are preferably provided with connection ratchets 77 at one end. The connection ratchets 77 enable the straps 76 to be secured and tightened around the channels 50 and 54 and the panel 100.

An installation, rail system 80 is used with the apparatus 10 to assist in the installation of the panels 100 onto the ceiling rails (FIGS. 9 to 12). The rail system 80 includes an entry rail 82 having a keyway 88 and a rail key 95. The entry rail 82 includes preferably identical left and right rail segments 84 and 86 with a keyway 88 therebetween and is preferably mounted between two aligned ceiling rails. Alternately, the entry rail 82 can be mounted at the end of the ceiling rails. The rail segments 84 and 86 are preferably similar in shape, size and construction to the ceiling rails and each have a top wall 84A and 86A, a bottom wall 84B and 86B and sidewalls 84C and 86C forming center openings (not shown) with a slot (not shown) in the bottom wall 84B and 86B. The rail segments 84 and 86 are mounted similarly to the ceiling rails with the top walls 84A and 86A parallel and adjacent to the ceiling of the building. The rail segments 84 and 86 are mounted on the ceiling such that the slots in the bottom walls 84B and 86B of the rail segments 84 and 86 are aligned with the slots in the bottom walls of the adjacent ceiling rails. The keyway 88 allows for mounting the panels 100 into the entry rail 82 and thus, the ceiling rails. The keyway 88 has a width at least as wide as the width of the panel 100 to be installed. The keyway 88 is preferably located in the center of the entry rail 82 such that the left and right rail segments 84 and 86 extend outward an identical length on either side of the keyway 88. In the preferred embodiment, the ends 84D and 86D of each rail segment 84 and 86 adjacent the keyway 88 are angled downward such that the bottom walls 84B and 86B of the rail segments 84 and 86 extend into the keyway 88 farther than the top walls 84A and 86A of the rail segments 84 and 86. The ends 84D and 86D of each rail segment 84 and 86 adjacent the keyway 88 is provided with positioning bars 94 on each sidewall. The positioning bars 94 assist in correctly mounting the rail key 95 in the keyway 88 and also prevent the rail key 95 from falling forward or backward out of the keyway 88 once positioned between the rail segments 84 and 86.

The rail key 95 is also preferably similar in construction to the ceiling rails and has a top wall 95A, a bottom wall 95B with sidewalls 95C therebetween, a central opening 96 formed by the walls 95A, 95B and 95C and a slot 95D in the bottom wall 95B. The rail key 95 preferably has a length slightly smaller than the width of the keyway 88 with the length of the bottom wall 95B of the rail key 95, preferably only slightly greater than the width of the panel 100. The ends 95E of the rail key 95 are preferably angled upwardly such that the top wall 95A of the rail key 95 is longer than the bottom wall 95B of the rail key 95. The interlocking shapes of the rail key 95 and the keyway 88 prevent the rail key 95 from falling through the keyway 88 and allow the rail key 95 to be supported by the rail segments 84 and 86 of the entry rail 82. The top wall 95A of the rail key 95 is provided with support bars 98 mounted at each end 95E which extend beyond each end 95E of the rail key 95. The support bars 98 also prevent the rail key 95 from falling through the keyway 88 and also help distribute the weight of the rail key 95 and panel 100 onto the adjacent rail segments 84 and 86 of the entry rail 82. Preferably, the entry rail 82 and rail key 95 are constructed of steel although other materials could also be used.

IN USE

Prior to installation of the panels 100, the ceiling rails are mounted on the ceiling of the building. One of the ceiling rails in each line is left out in order to allow for temporary mounting of the entry rail 82 aligned with the ceiling rails for installing the panels 100. To install the divider wall panels 100 using the panel installing apparatus 10, the base members 14 of the base 12 of the apparatus 10 are attached to the attachment plate 201 of a forklift truck 200. The lifting tines (not shown) of the forklift truck 200 are removed before the apparatus 10 is attached. To attach the apparatus 10 to the forklift truck 200, the upper support bar 15 is lifted over the upper extension 201A of the attachment plate 201 of the forklift truck 200 such that the upper extension 201A is between the upper support bar 15 and the base members 14 (FIG. 1). In the preferred embodiment, the lower support bar 16 is then mounted in the slots 14A on the base members 14 such as to extend over the lower extension 201B of the attachment plate 201 of the forklift truck 200. Consequently, the attachment plate 201 is sandwiched between the support bars 15 and 16 of the base 12. Alternately, the lower support bar 16 is left off and the base 12 is hooked over the upper extension 201A of the attachment plate 201. The apparatus 10 is mounted such that the holding and support channels 50 and 54 are parallel to the ground surface 202 (FIG. 2).

To mount the panel 100 in the apparatus 10, the apparatus 10 is moved adjacent a stack of panels 100. In the preferred embodiment, the panels 100 are stored horizontally on their sides 100C on panel racks which are mounted beneath the middle of the panel 100 and which raise the panel 100 off the ground surface 202. The space between the support channels 50 and similarly the vertical members 24 of the frame 22, enables the apparatus 10 to be positioned such that the support channels 50 are underneath the side 100C of the panel 100 adjacent the ground surface 202 on either side of the panel rack. The apparatus 10 is then lifted, slightly, using the forklift truck 200 such that the floors 50B of the support channels 50 are in contact with the side 100C of the panel 100. The holding channel 54 is then lowered so that the floor 54B of the holding channel 54 is in contact with the other side 100C of the panel 100. Thus, the panel 100 is initially mounted in the apparatus 10 in the horizontal position such that the sides 100C of the panel 100 are parallel to the ground surface 202 (FIG. 2). The holding channel 54 is preferably lowered until the panel 100 is held firmly between the support and holding channel 50 and 54. The channels 50 and 54 do not need to be adjusted to hold the panel 100 motionless within the channels 50 and 54 but only need to hold the panel 100 so that the panel 100 can not fall from between the holding channel 54 and the support channels 50 and such that there is no extensive extraneous movement of the panel 100 in the apparatus 10. The coverings 73 and 74 on the floors 50B and 54B of the support and holding channels 50 and 54 preferably prevent the channels 50 and 54 from damaging the sides 100C of the panel 100 during installation. Finally, preferably the securing straps 76 are secured around the panel 100 and the channels 50 and 54. To secure the straps 76 in place, one end of the strap 76 is inserted through the ratchet 77 at the other end of the strap 76. In the preferred embodiment, the straps 76 are mounted adjacent each of the support channels 50 spaced between the attachment mount 71 and the frame 22 on the support channels 50 and between the attachment mount 70 and the handle 59 on each end of the holding channel 54 (FIG. 2). The straps 76 are mounted such that the ratchets 77 are on the side of the panel 100 opposite the frame 22 of the apparatus 10 in order to enable the user to easily tighten the straps 76.

Alternately, when the apparatus 10 is used to install a smaller panel 100 such as a door, an alternate way of securing the panel 100 in the apparatus 10 can be used. As shown in FIG. 13, once the panel 100 is resting on the support channels 50 in the horizontal position, a single securing strap 76 is secured around the panel 100 and the support channels 50 and preferably, also extend through and around the vertical members 24 or cross members 26 of the frame 22 of the apparatus 10 to fully secure the panel 100 to the apparatus 10. Since the holding channel 54 does not need to be used, the channels 54 can be moved to the top of the frame 22 and secured by the positioning knobs 58 out of the way. Alternately, the channel 54 can be removed from the frame 22. If the channel 54 is removed, then the end 64A of the first cable 64 of the securing end 60 would be secured to the vertical member 24 of the frame 22. In addition, the length of the securing end channel 60 can be adjusted to the width of the panel 100 mounted in the apparatus 10.

Once the panel 100 is in the apparatus 10, the forklift truck 200 is then backed up such as to remove the panel 100 from the panel rack. Next, to securely mount the panel 100 in the apparatus 10, the second cable 66 of the securing end channel 60 is fastened at one end 66A to the attachment mount 71 on the bottom surface 50E of the support channel 50. The end channel 60 is then positioned over one end 100B of the panel 100 and the first cable 64 is secured to the attachment mount 70 on the top surface 54C of the floor 54B of the holding channel 54. Preferably, the cables 64 and 66 are attached to the eye bolts 62 on the end channel 60 before the end channel 60 is positioned on the end 100B of the panel 100. The eye bolts 62 on the inner surface 60C of the floor 60B of the end channel 60 allow the end channel 60 to be positioned and remain on the end 100B of the panel 100 while the cables 64 and 66 are attached. The cables 64 and 66 can be attached in any order and preferably the end channel 60 can be attached to either end 100A or 100B of the panel 100 provided the ends 50C or 50D of the support and holding channels 50 and 54 adjacent the end 100A or 100B of the panel 100 to be used are provided with attachment mounts 70 or 71. In addition, the end 100B of the panel 100 provided with the sliding wheels 102 which allow the panels 100 to move along the ceiling rails can not be used for the end channel 60. Once the end channel 60 is positioned on the end 100B of the panel 100, the turn buckles 69 on the cables 64 and 66 are tightened in order to tension the cables 64 and 66 and securely position the end channel 60 on the end 100B of the panel 100. The covering 75 on the inner surface 60C of the floor 60B of the end channel 60 preferably protects the end 100B of the panel 100 from damage during installation.

Once the panel 100 is secured in the apparatus 10, the forklift truck 200 with the apparatus 10 and the panel 100 are moved to a position below and adjacent to the entry rail 82. The apparatus 10 and the panel 100 are then lifted toward the ceiling rails. As the panel 100 is lifted, the frame 22 with the panel 100 rotates on the base 12 such that the end 100B of the panel 100 having the end channel 60 moves toward the ground surface 202.

In the preferred embodiment, a user, assisting in the rotation, guides the panel 100 around. Alternately, the weight of the end channel 60 on one end 100B of the panel 100 causes that end 100B of the panel 100 to move downward, due to gravity, as the panel 100 is raised upward. The end channel 60 on the end 100B of the panel 100, prevents the panel 100 from slipping downward out of the apparatus 10 and allows the panel 100 to be lifted. In the preferred embodiment, once the panel 100 is lifted and in the upright, vertical position, the end channel 60 preferably is parallel to the ground surface 202 (FIG. 7). Once the panel 100 is in the vertical position, a user (not shown) on a lift or ladder (not shown) adjacent the ceiling rails is able to position the rail key 95 on the end 100A of the panel 100 having the sliding wheels 102. The rail key 95 is positioned on the end of the panel 100 such that the bottom wall 95B of the rail key 95 is spaced inward an equal distance from each side 100C of the panel 100. The panel 100 is then moved toward the ceiling rails such that the panel 100 is positioned between the rail segments 84 and 86 of the entry rail 82 in the keyway 88 and the rail key 95 is positioned above the keyway 88 on the end 100B of the panel 100. If necessary, the panel 100 is further lifted after the rail key 95 is attached in order that the end 100B of the panel 100 with the rail key 95 is spaced above the top walls 84A and 86A of the rail segments 84 and 86 of the entry rail 82 at least a distance as great as the height of the sidewalls of the ceiling rails. Alternately, the rail key 95 can be positioned on the end 100B of the panel 100 after the panel 100 has been lifted and positioned in the keyway 88. Once correctly positioned in the keyway 88, the apparatus 10 and the panel 100 with the rail key 95 are lowered such that the rail key 95 is positioned within the keyway 88 of the entry rail 82. The interlocking shape of the rail key 95 and keyway 88 along with the support bars 98 and the positioning bars 94 correctly position the rail key 95 in the keyway 88 such that the slot 95D in the bottom wall 95B of the rail key 95 is aligned with the slots in the bottom walls 84B and 86B of the rail segments 84 and 86 of the entry rail 82, and consequently, the slots of the ceiling rails. The apparatus 10 continues to be lowered as the panel 100 remains lifted due to the wheels 102 mounted in the opening 96 of the rail key 95 and the rail key 95 held in the keyway 88. In the preferred embodiment, the distance between the support and holding channel 50 and 54 of the apparatus 10 allows the panel 100 to slide between the channels 50 and 54 without damaging the panel 100. Alternately, the holding channel 54 can be originally tightened down and then can be loosened by the user after the rail key 95 is positioned within the keyway 88 in order to allow the apparatus 10 to be lowered. Once the apparatus 10 is completely removed from around the panel 100, the panel 100 is then rolled out of the rail key 95 and the entry rail 82 into the ceiling rails. The rail key 95 is then removed from the keyway 88 and is stored above the rail segments 84 and 86 for use with the next panel 100 to be installed. Once all the panels 100 have been installed, the entry rail 82 is removed and replaced with a permanently mounted ceiling rail. The entry rail 82 and rail key 95 can then be used elsewhere to install other divider wall panels 100.

It is intended that the foregoing description be only illustrative of the present invention and that the present invention be limited only by the hereinafter appended claims.

We claim:

1. An apparatus for use with a lifting vehicle having wheels for installing divider wall panels into ceiling rails where the panels have opposed ends with spaced apart sides therebetween, the apparatus which comprises:

(a) a base with attachment means for attaching to the lifting vehicle;

(b) a frame rotatably mounted on the base and having a top and a bottom with opposed sides extending therebetween when the frame is oriented for mounting a panel on the apparatus;

(c) a support channel mounted on the bottom of the frame wherein when the panel is positioned in the apparatus, the support channel is adjacent one side of the panel;

(d) an adjustable holding means mounted on the frame so as to hold the panel in the support channel; and (e) a support means connected to, spaced apart from and extending between the support channel and the holding means wherein the support means is extendable to engage one of the ends of the panel when the panel is positioned in the apparatus and wherein to position the panel for installation into the ceiling rails, the frame with the panel is rotated approximately about 90° on the base so that the support means is adjacent a ground surface.

2. The apparatus of claim 1 wherein the holding means is a securing strap mounted on the frame for holding the panel.

3. The apparatus of claim 1 wherein the holding means is a holding channel mounted on the frame such that when the panel is positioned in the apparatus, the support channel is adjacent one side of the panel and the holding channel is adjacent the other side of the panel.

4. An apparatus for use with a lifting vehicle having wheels for installing divider wall panels into ceiling rails where the panels have opposed ends with spaced apart sides therebetween, the apparatus which comprises:

(a) a base with attachment means for attaching to the lifting vehicle;

(b) a frame rotatably mounted on the base and having a top and a bottom with opposed sides extending therebetween when the frame is oriented for mounting a panel on the apparatus;

(c) a support channel mounted on the bottom of the frame;

(d) an adjustable holding means mounted on the top of the frame spaced apart from and parallel to the support channel wherein when the panel is positioned in the apparatus, the support channel is adjacent one side of the panel and the holding means is adjacent the other side of the panel; and (e) a support means connected to, spaced apart from and extending between the support channel and the holding means wherein the support means is extendable to engage one of the ends of the panel when the panel is positioned in the apparatus and wherein to position the panel for installation into the ceiling rails, the frame with the panel is rotated approximately about 90° on the base so that the support means is adjacent a ground surface.

5. The apparatus of claim 4 wherein the sides of the frame are a pair of parallel, vertical members.

6. The apparatus of claim 5 wherein the vertical members are connected together by cross members which meet at a central connection point between the vertical members and form an X between the vertical members.

7. The apparatus of claim 6 wherein the frame is mounted on the base at the central connection point.

8. The apparatus of claim 4 wherein the support means is a U-shaped end channel.

9. The apparatus of claim 8 wherein the end channel is connected to the support channel and holding means by adjustable cables.

10. The apparatus of claim 4 wherein the support channel is comprised of a pair of support segment channels which are mounted in a spaced apart position on the frame.

11. The apparatus of claim 4 wherein the lifting vehicle is a forklift truck.

12. The apparatus of claim 4 wherein the holding means is able to be spaced apart from the support channel between about 2 and 6.5 feet (61 and 198 cm).

13. The apparatus of claim 4 wherein the apparatus is able to install a panel having a length of between about 12 and 40 feet (366 and 1219 cm) and a width of between about 2 and 6 feet (61 and 183 cm).

14. The apparatus of claim 4 wherein securing straps are provided around the holding means and support channel to hold the panel in the apparatus.

15. An apparatus for use with a lifting vehicle having wheels for installing divider wall panels into ceiling rails for a commercial building where the panels have opposed ends with spaced apart sides therebetween and are at least between about 12 and 40 feet (366 and 1219 cm) long and between about 2 and 6 feet (61 and 183 cm) wide, the apparatus which comprises:

(a) a base with attachment means for attaching to the lifting vehicle;

(b) a frame rotatably mounted on the base and having a top and a bottom with opposed sides extending therebetween when the frame is oriented for mounting a panel on the apparatus;

(c) a support channel mounted on the bottom of the frame;

(d) an adjustable holding means mounted on the top of the frame spaced apart from and parallel to the support channel wherein when the panel is positioned in the apparatus, the support channel is adjacent one side of the panel and the holding means is adjacent the other side of the panel; and (e) a support means connected to and spaced apart from the support channel and the holding means wherein the support means is extendable to engage one of the ends of the panel when the panel is positioned in the apparatus and wherein to position the panel for installation into the ceiling rails, the frame with the panel is rotated approximately about 90° on the base so that the support means is adjacent a ground surface.

16. An apparatus for use with a lifting vehicle having wheels for installing divider wall panels into ceiling rails where the panels have opposed ends with spaced apart sides therebetween, the apparatus which comprises:

(a) a base with attachment means for attaching to the lifting vehicle;

(b) a frame rotatably mounted on the base and having a top and a bottom with a pair of opposed parallel vertical members extending therebetween when the frame is oriented for mounting a panel on the apparatus wherein the vertical members are connected together by cross members which meet at a central connection point between the vertical members and form an X between the vertical members;

(c) a support channel mounted on the bottom of the frame;

(d) an adjustable holding means mounted on the top of the frame spaced apart from and parallel to the support channel wherein when the panel is positioned in the apparatus, the support channel is adjacent one side of the panel and the holding means is adjacent the other side of the panel; and (e) a support means connected to, spaced apart from and extending between the support channel and the holding means wherein the support means is extendable to engage one of the ends of the panel when the panel is positioned in the apparatus and wherein to position the panel for installation into the ceiling rails, the frame with the panel is rotated approximately about 90° on the base so that the support means is adjacent a ground surface.

17. The apparatus of claim 16 wherein the frame is mounted on the base at the central connection point.

18. An apparatus for use with a lifting vehicle having wheels for installing divider wall panels into ceiling rails where the panels have opposed ends with spaced apart sides therebetween, the apparatus which comprises:

(a) a base with attachment means for attaching to the lifting vehicle;

(b) a frame rotatably mounted on the base and having a top and a bottom with opposed sides extending therebetween when the frame is oriented for mounting a panel on the apparatus;

(c) a support channel mounted on the bottom of the frame;

(d) an adjustable holding means mounted on the top of the frame spaced apart from and parallel to the support channel wherein when the panel is positioned in the apparatus, the support channel is adjacent one side of the panel and the holding means is adjacent the other side of the panel; and (e) a U-shaped end channel connected to, spaced apart from and extending between the support channel and the holding means wherein the end channel is connected to the support channel and holding means by adjustable cables and is extendable to engage one of the ends of the panel when the panel is positioned in the apparatus and wherein to position the panel for installation into the ceiling rails, the frame with the panel is rotated approximately about 90° on the base so that the end channel is adjacent a ground surface.

* * * * *